US010490340B2

(12) United States Patent
Yoshida et al.

(10) Patent No.: US 10,490,340 B2
(45) Date of Patent: Nov. 26, 2019

(54) REACTOR HAVING FUNCTION OF PREVENTING ELECTRICAL SHOCK

(71) Applicant: FANUC CORPORATION, Minamitsuru-gun, Yamanashi (JP)

(72) Inventors: Tomokazu Yoshida, Yamanashi (JP); Masatomo Shirouzu, Yamanashi (JP); Kenichi Tsukada, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 16/044,768

(22) Filed: Jul. 25, 2018

(65) Prior Publication Data

US 2019/0035542 A1 Jan. 31, 2019

(30) Foreign Application Priority Data

Jul. 26, 2017 (JP) ..... 2017-144842

(51) Int. Cl.

| | |
|---|---|
| ***H01F 27/29*** | (2006.01) |
| ***H01F 27/36*** | (2006.01) |
| ***H01F 27/26*** | (2006.01) |
| ***H01R 9/24*** | (2006.01) |
| ***H01R 13/447*** | (2006.01) |
| *H01F 3/14* | (2006.01) |

(52) U.S. Cl.

CPC ..... *H01F 27/362* (2013.01); *H01F 27/263* (2013.01); *H01F 27/29* (2013.01); *H01R 9/24* (2013.01); *H01R 13/447* (2013.01); *H01F 3/14* (2013.01)

(58) Field of Classification Search

CPC ..... H01F 27/362; H01F 3/14; H01F 27/29; H01F 27/263

USPC ..... 336/5, 192

See application file for complete search history.

(56) References Cited

U.S. PATENT DOCUMENTS 3,188,592 A * 6/1965 Kukla ..... H01F 27/40 336/192
3,479,563 A * 11/1969 Roy ..... H01F 27/402 361/41

(Continued)

FOREIGN PATENT DOCUMENTS

JP 2005235730 A 9/2005
JP 2009-283706 A 12/2009

(Continued)

*Primary Examiner* — Tszfung J Chan
(74) *Attorney, Agent, or Firm* — RatnerPrestia

(57) ABSTRACT

A reactor includes a core body including an outer peripheral iron core, at least three iron cores contacting to an internal surface of the outer peripheral iron core, and coils wound on the iron cores. A gap is formed between one and another of the iron cores adjacent each other, so as to be magnetically connectable therethrough. The reactor has a terminal base connected to cables through current carrying portions, as well as connected to the coils, and an electrical shock prevention cover for covering the terminal base. The electrical shock prevention cover has openings for passing the cables connected to the terminals therethrough. The terminal base has a plate that blocks at least a part of each opening to prevent a finger from touching the current carrying portion while the cables are connected to the terminals and which is detachable in accordance with the thickness of the cables.

5 Claims, 7 Drawing Sheets

(56) References Cited

U.S. PATENT DOCUMENTS

| | | | | |
|---|---|---|---|---|
| 4,804,340 | A * | 2/1989 | Hamer | H01R 9/24 336/192 |
| 6,185,811 | B1 * | 2/2001 | Perry | H01F 27/22 29/602.1 |
| 7,768,370 | B2 * | 8/2010 | Brown | H01F 27/027 336/200 |
| 2002/0014941 | A1 * | 2/2002 | Yoshioka | H01F 27/266 336/184 |
| 2005/0164564 | A1 | 7/2005 | Kawata et al. | |
| 2006/0279393 | A1 * | 12/2006 | Shudarek | H01F 27/263 336/198 |
| 2008/0197961 | A1 * | 8/2008 | Patel | H01F 21/12 336/170 |
| 2009/0243769 | A1 * | 10/2009 | Takaya | H01H 50/045 335/127 |
| 2014/0292456 | A1 * | 10/2014 | Suzuki | H01F 27/402 336/55 |
| 2018/0254135 | A1 | 9/2018 | Tsukada et al. | |

FOREIGN PATENT DOCUMENTS

| | | | |
|---|---|---|---|
| JP | 2012022940 | A | 2/2012 |
| JP | 6363750 | B1 | 7/2018 |

* cited by examiner

REACTOR HAVING FUNCTION OF PREVENTING ELECTRICAL SHOCK

This application is a new U.S. patent application that claims benefit of JP 2017-144842 filed on Jul. 26, 2017, the content of JP 2017-144842 is incorporated herein by reference.

BACKGROUND OF THE INVENTION

1. Field of the Invention

The present invention relates to a reactor, and more specifically relates to a reactor having the function of preventing an electrical shock.

2. Description of Related Art

Alternating current (AC) reactors are used in order to reduce harmonic current occurring in inverters, etc., to improve input power factors, and to reduce inrush current to the inverters. Such AC reactors have a core made of a magnetic material and a coil formed around the core.

Three-phase AC reactors each including three-phase coils (windings) arranged in a line have been known (for example, Japanese Unexamined Patent Publication (Kokai) No. 2009-283706, hereinafter referred to as "Patent Document 1"). Patent Document 1 discloses that each of the three windings is connected to a pair of terminals at both ends, and the reactor is connected to another electrical circuit through the pairs of terminals.

In reactors, the thickness (cross-sectional area) of cables to be used is sometimes designated in conformity with standards (for example, adhering or not adhering to the U.S. standards NFPA). Taking the U.S. standards NFPA as an example, the cables become thicker when adhering to the standards than when not adhering to the standards.

SUMMARY OF THE INVENTION

Since an electrical shock prevention cover for a reactor terminal base is attached from the top of a terminal base, the cover is partly cut away so as to avoid connected cables. Therefore, although thick cables connected to the terminal base prevent a finger from contacting current carrying portions, thin cables connected to the terminal base of the same size allow the finger to contact the current carrying portions.

A reactor according to an embodiment of the present disclosure includes a core body that includes an outer peripheral iron core, at least three iron cores disposed so as to contact the inside of the outer peripheral iron core or to be coupled to an internal surface of the outer peripheral iron core, and coils wound on the iron cores. In the reactor, a gap is formed between one of the iron cores and another of the iron cores adjacent to the one of the iron cores, so as to be magnetically connectable through the gap. Furthermore, the reactor includes a terminal base including a terminal configured to be connected to a cable through a current carrying portion, as well as connected to the coil, and an electrical shock prevention cover disposed so as to cover the terminal base. The electrical shock prevention cover has an opening through which the cable connected to the terminal can pass. The terminal base has a plate that is configured to block at least a part of the opening so as to prevent a finger from touching the current carrying portion in a state in which the cable is connected to the terminal, and that is detachable in accordance with the thickness of the cable.

BRIEF DESCRIPTION OF THE DRAWINGS

The objects, features, and advantages of the present invention will be more apparent from the following description of embodiments accompanying with the drawings. In the drawings.

DETAILED DESCRIPTION OF THE INVENTION

Figure 1A:
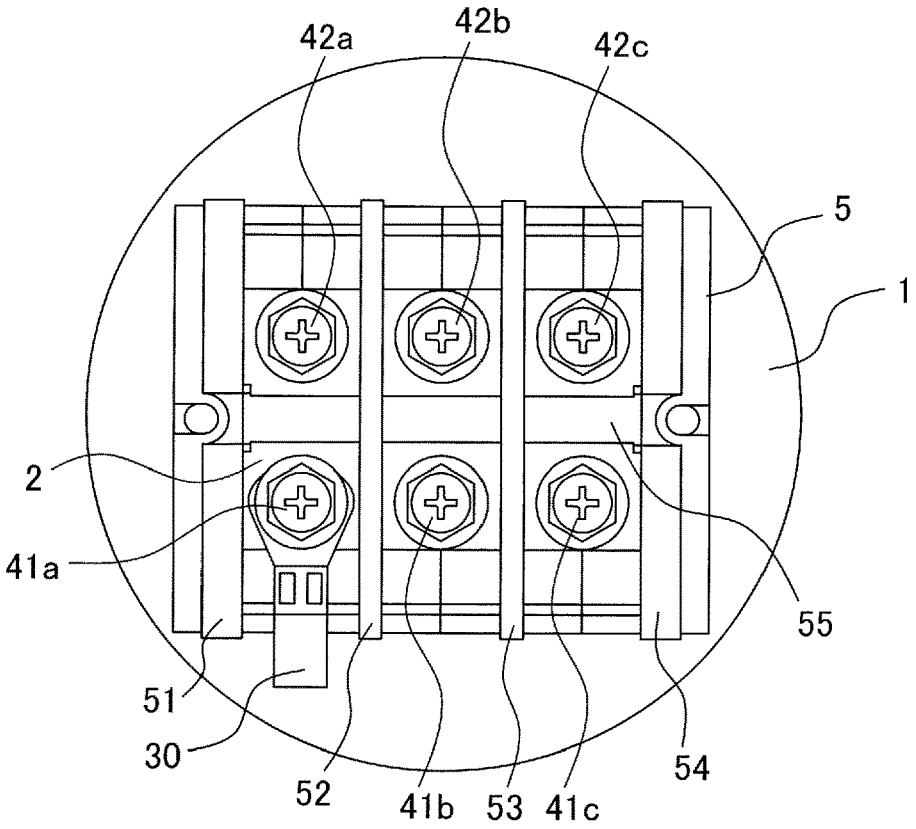
FIG. 1A is a plan view of a reactor according to a first embodiment, including a terminal base to which a thick cable is connected.

Embodiments of the present invention will be described below with reference to the accompanying drawings. In the drawings, the same reference numerals indicate the same components. For ease of understanding, the scales of the drawings are modified in an appropriate manner.

The following description mainly describes three-phase reactors as examples. However, the application of the present disclosure is not limited to three-phase reactors, and the present disclosure can be widely applied to multi-phase reactors that require constant inductance in each phase. The reactors according to the present disclosure can be applied to various types of equipment, as well as applied to the primary sides and secondary sides of inverters in industrial robots and machine tools.

A reactor according to a first embodiment will be described. FIG. 1A is a plan view of the reactor according to the first embodiment, including a terminal base to which a thick cable (having large cross-sectional area) is connected.

Figure 1B:
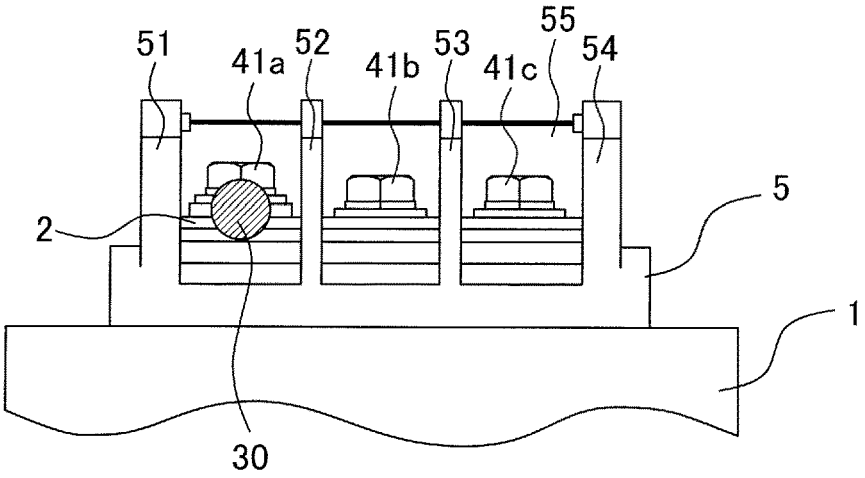
FIG. 1B is a side view of the reactor according to the first embodiment, including the terminal base to which the thick cable is connected.

FIG. 1B is a side view of the reactor including the terminal base to which the thick cable is connected. The thick cable is used, for example, when adhering to the U.S. standards (NFPA). The reactor according to the first embodiment includes a core body 1. The core body 1 includes an outer peripheral iron core (not shown), at least three iron cores (not shown) disposed so as to contact the inside of the outer peripheral iron core or to be coupled to a surface (internal surface) of the inside thereof, and coils (not shown) wound on the iron cores. A gap is formed between one of the iron cores and another of the iron cores adjacent to the one of the iron cores, so as to be magnetically connectable through the gap. A terminal base 5 includes terminals (41*a* to 41*c*, and 42*a* to 42*c*) each of which is connected to a coil and configured to be connected to a cable 30 through a current carrying portion 2.

In the example of FIG. 1A, the terminal base 5 includes the six terminals (41*a* to 41*c*, and 42*a* to 42*c*). For example, the terminals 41*a* to 41*c* may be input terminals and the terminals 42*a* to 42*c* may be output terminals. The terminals 41*a* and 42*a* may be R-phase terminals. The terminals 41*b* and 42*b* may be S-phase terminals. The terminals 41*c* and 42*c* may be T-phase terminals. However, the present invention is not limited to this example.

Each of the terminals (41*a* to 41*c*, and 42*a* to 42*c*) is connected to the cable 30 through a current carrying portion 2. The terminals (41*a* to 41*c*, and 42*a* to 42*c*) and the current carrying portions 2 are insulated by side walls 51 to 55. In the following description, the core body 1 is omitted.

Figure 2A:
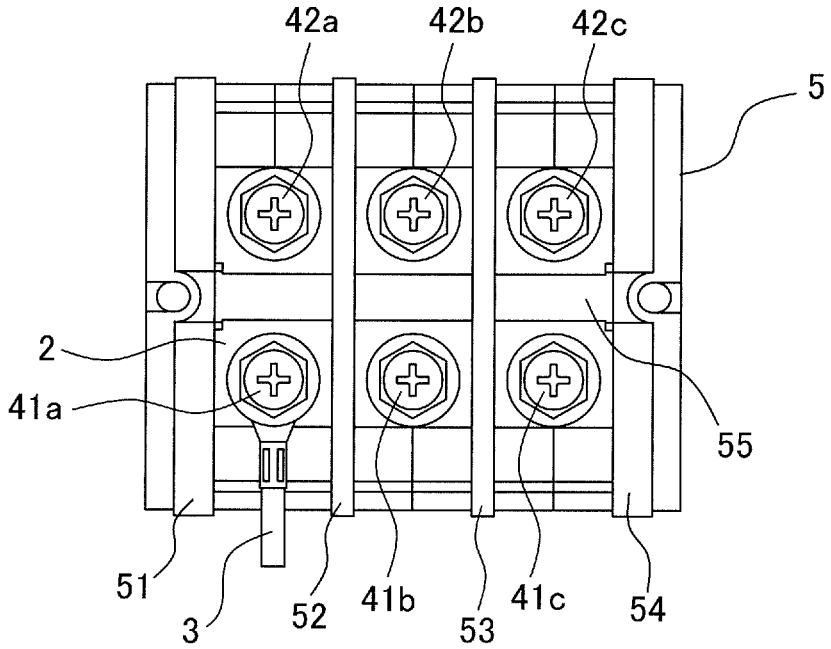
FIG. 2A is a plan view of the terminal base included in the reactor according to the first embodiment, in which a thin cable is connected to the terminal base.
Figure 2B:
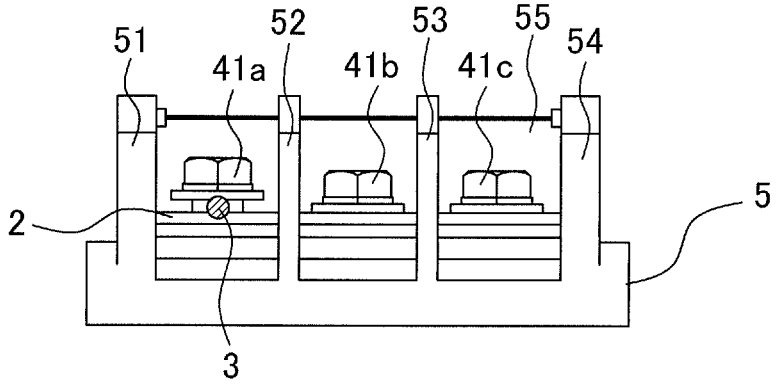
FIG. 2B is a side view of the terminal base included in the reactor according to the first embodiment, in which the thin cable is connected to the terminal base.

FIG. 2A is a plan view of the terminal base included in the reactor according to the first embodiment, in which a thin cable (having a small cross-sectional area) is connected to the terminal base. FIG. 2B is a side view of the terminal base included in the reactor according to the first embodiment, in which the thin cable is connected to the terminal base. Cable 3 shown in FIGS. 2A and 2B is thinner than the cable 30 shown in FIGS. 1A and 1B. For example, the thin cable is used when not adhering to the U.S. standards (NFPA).

Figure 3A:
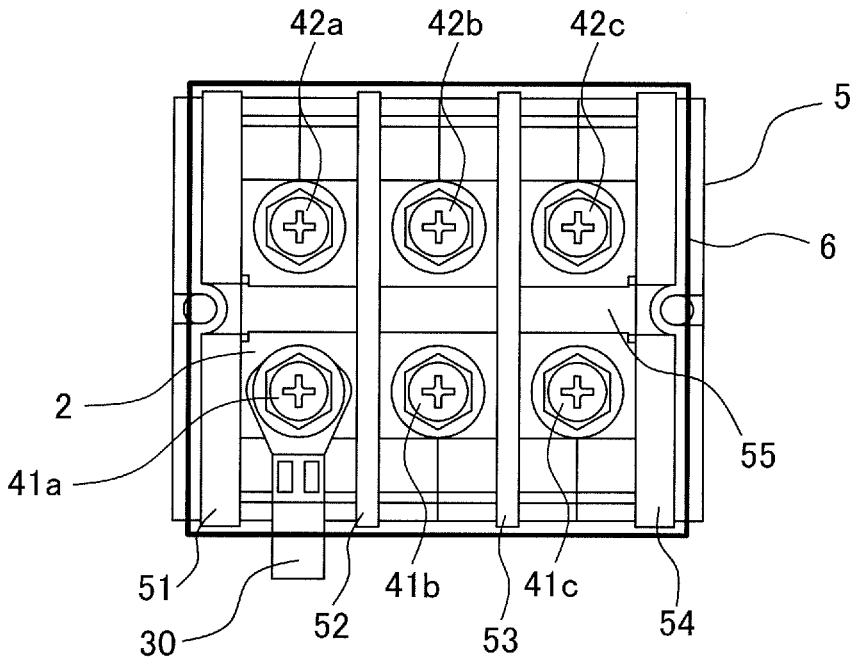
FIG. 3A is a plan view of the terminal base included in the reactor according to the first embodiment, in which the thick cable is connected to the terminal base covered with an electrical shock prevention cover.
Figure 3B:
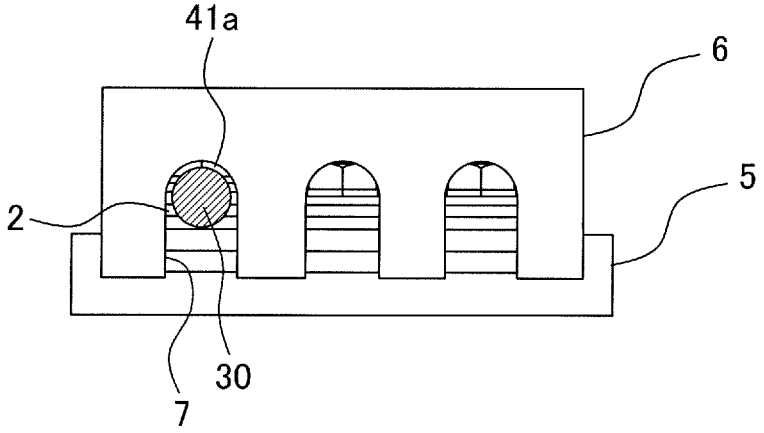
FIG. 3B is a side view of the terminal base included in the reactor according to the first embodiment, in which the thick cable is connected to the terminal base covered with the electrical shock prevention cover.

FIG. 3A is a plan view of the terminal base included in the reactor according to the first embodiment, in which the thick cable is connected to the terminal base covered with an electrical shock prevention cover. FIG. 3B is a side view of the terminal base included in the reactor according to the first embodiment, in which the thin cable is connected to the terminal base covered with the electrical shock prevention cover. An electrical shock prevention cover 6 is disposed so as to cover the terminal base 5. Since the electrical shock prevention cover 6 covers the terminals (41*a* to 41*c*, and 42*a* to 42*c*), it is possible to prevent a finger from touching the terminal base 5 from above and receiving an electrical shock.

As shown in FIG. 3B, the electrical shock prevention cover 6 has openings 7 through one of which the cable 30 connected to the terminal 41*a* is passed. As shown in FIG. 3B, when the thick cable 30 is connected to the terminal 41*a*, no gap of a size so as to allow a finger to get in the current carrying portion 2 is formed. Therefore, there is no need to attach a plate, which is described later.

Figure 4A:
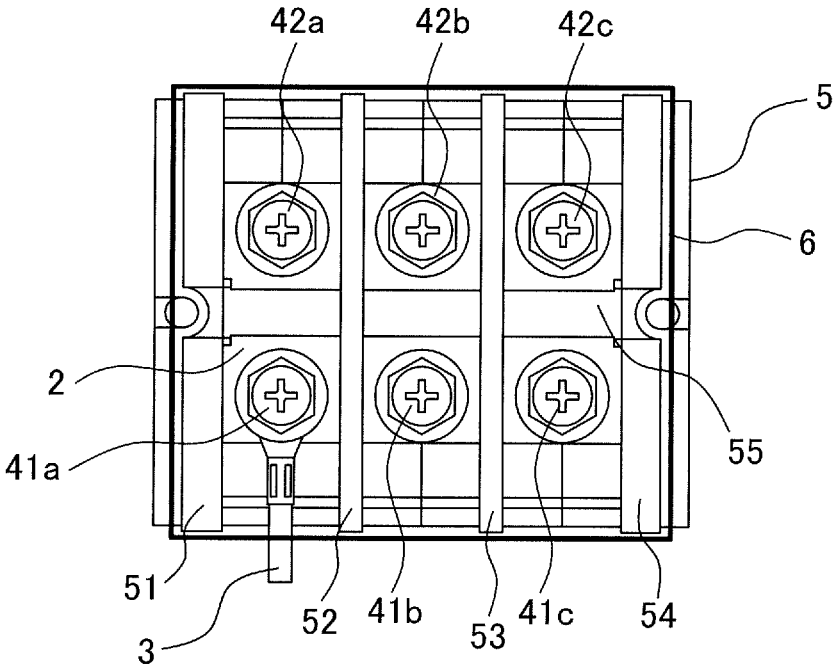
FIG. 4A is a plan view of the terminal base included in the reactor according to the first embodiment, in which the thin cable is connected to the terminal base covered with the electrical shock prevention cover.
Figure 4B:
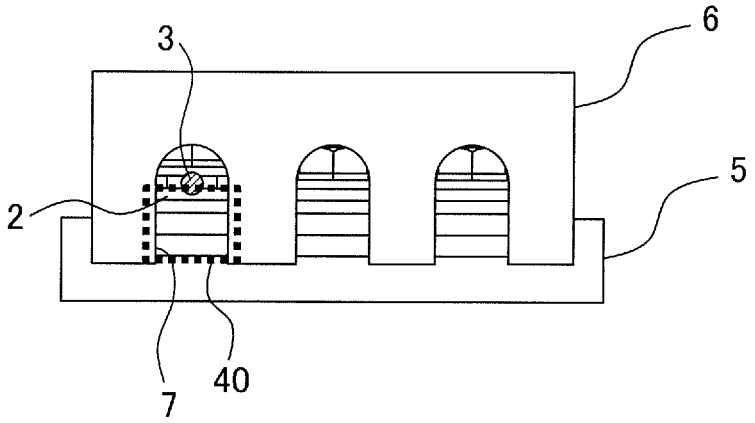
FIG. 4B is a side view of the terminal base included in the reactor according to the first embodiment, in which the thin cable is connected to the terminal base covered with the electrical shock prevention cover.

FIG. 4A is a plan view of the terminal base included in the reactor according to the first embodiment, in which a thin cable is connected to the terminal base covered with the electrical shock prevention cover. FIG. 4B is a side view of the terminal base included in the reactor according to the first embodiment, in which the thin cable is connected to the terminal base covered with the electrical shock prevention cover. The cable 3 shown in FIGS. 4A and 4B is thinner than the cable 30 shown in FIGS. 3A and 3B. Therefore, when an opening 7 of a size so as to pass the thick cable 30 therethrough is formed in the electrical shock prevention cover, as shown in FIG. 4B, a gap of a size so as to allow a finger to pass is likely to be formed around the cable 3.

Figure 5:
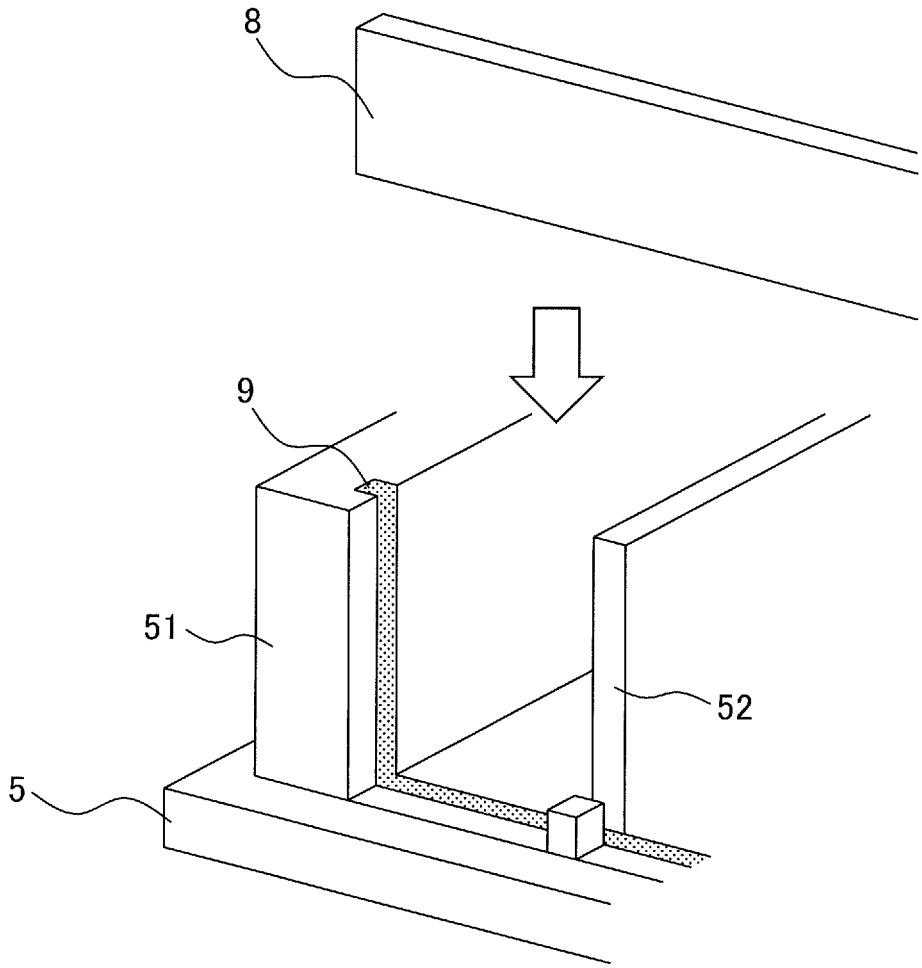
FIG. 5 is a perspective view of the terminal base of the reactor and a plate attached to the terminal base according to the first embodiment.

Therefore, in the reactor according to the first embodiment, the terminal base 5 includes a plate that is configured to cover at least a part of each opening 7 in order to prevent a finger from touching the current carrying portion 2 when the cables (3 or 30) are connected to the terminals, and that is detachable in accordance with the thickness of the cables (3 or 30). FIG. 5 is a perspective view of the terminal base 5 of the reactor and a plate 8 attached to the terminal base 5, according to the first embodiment. A slit 9 is preferably formed in the terminal base 5 in the vicinity of the openings 7 (refer to FIGS. 3B and 4B), to fit the plate 8 therein. The slit 9 may be formed in side walls 51, 52, etc. After the slit 9 has been formed, the plate 8 is inserted in the direction indicated by the arrow shown in FIG. 5 to attach the plate 8 to the terminal base 5.

Figure 6A:
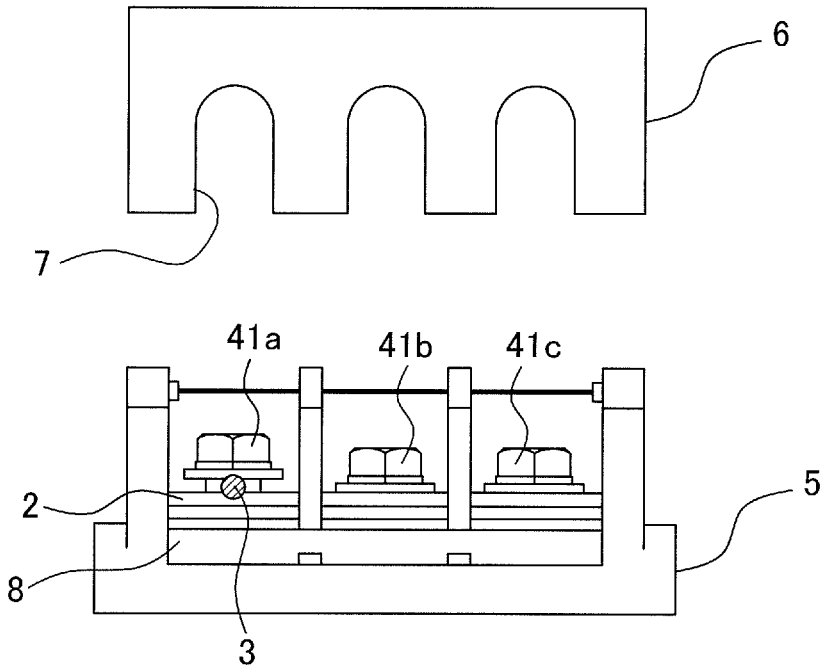
FIG. 6A is a side view of the terminal base having the plate, and the electrical shock prevention cover, in the reactor according to the first embodiment.
Figure 6B:
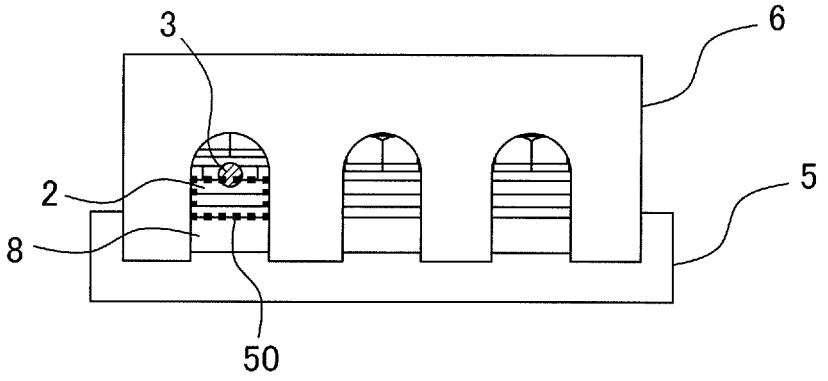
FIG. 6B is a side view of the terminal base to which the plate and the electrical shock prevention cover are attached, in the reactor according to the first embodiment.

FIG. 6A is a side view of the terminal base having the plate, and the electrical shock prevention cover, in the reactor according to the first embodiment. FIG. 6B is a side view of the terminal base to which the plate and the electrical shock prevention cover are attached, in the reactor according to the first embodiment. As shown in FIG. 6A, after the plate 8 has been inserted into the terminal base 5, the electrical shock prevention cover 6 is attached from above.

As shown in FIG. 6B, the plate 8 covers a part of each opening 7 of the electrical shock prevention cover 6. Thus, even when the cable 3 is thin, a gap 50 formed in each opening 7 is reduced to a size so as not to allow a finger to enter therein. As a result, even when the thin cables 3 are connected to the terminal base 5, it is possible to prevent a finger from touching the current carrying portion 2 through the gaps formed in the openings 7 of the electrical shock prevention cover 6.

As described above, when the cables 30 are connected to the terminals (41*a* to 41*c*, and 42*a* to 42*c*), the cables having a thick diameter block the openings 7, without using the plate 8. Thus, when a finger does not contact the current carrying portions 2, the plate 8 may be detached. When the cables 3 are connected to the terminals (41*a* to 41*c*, and 42*a* to 42*c*), the cables having a thin diameter do not block the openings 7, unless the plate 8 is used. When a finger can contact the current carrying portions 2, the plate 8 may be attached.

In a first modification example of the first embodiment, for example, a plurality of types of plates having various heights may be prepared, and one of the plates that prevents a finger from contacting the current carrying portion 2 through the gap formed in each opening 7 may be selected in accordance with the thickness of cables connected to the terminal base 5.

Alternatively, in a second modification example of the first embodiment, considering that a plurality of types of cables of various thicknesses are connected to the terminal base 5, an elastically deformable plate may be attached, so that even when the thinnest cables are connected to the terminal base 5, a finger does not contact the current carrying portion 2. In this instance, the elastically deformable plate may be kept attached even when thick cables are connected to the terminal base 5.

In a third modification example of the first embodiment, considering that a plurality of types of cables of various thicknesses are connected to the terminal base 5, a plate that prevents a finger from touching the current carrying portion 2, even when thinnest cables are connected to the terminal base 5, may be provided. At this time, thickest cables may be connectable, while the plate is kept attached. In this instance, the thickness of the cables can be changed, while the plate is kept attached.

Next, a reactor according to a second embodiment will be described. The difference between the reactor according to the second embodiment and the reactor according to the first embodiment is that depressions are formed in the plate in accordance with the shape of cables. The other structure of the reactor according to the second embodiment is the same as that of the reactor according to the first embodiment, so a detailed description thereof is omitted.

Figure 7:
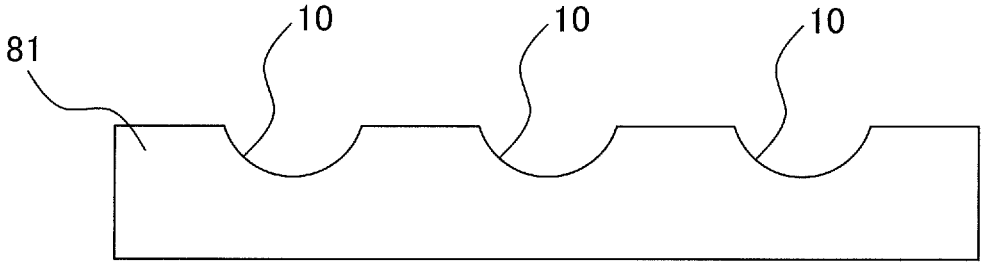
FIG. 7 is a plan view of a plate to be attached to a terminal base of a reactor according to a second embodiment.

FIG. 7 is a plan view of a plate attached to a terminal base of a reactor according to the second embodiment. As shown in FIG. 7, forming depressions 10 in a plate 81 enables a further reduction in the size of gaps formed in openings 7. Therefore, it is possible to further reduce the risk of contact of a finger to the current carrying portions 2.

In the above description, a board structure, i.e., the plate, etc., is attached to the openings of the electrical shock prevention cover. However, an opening dimension regulating member other than the plate may be attached instead. In other words, a reactor includes a core body that includes an outer peripheral iron core, at least three iron cores disposed so as to contact or be coupled to an internal surface of the outer peripheral iron core, and coils wound on the iron cores. The reactor preferably has the following structure. A gap is formed between one of the iron cores and another of the iron cores adjacent to the one of the iron cores, so as to be magnetically connectable through the gap. The reactor further includes a terminal base having terminals that are connected to the coils and configured to be connected to cables through current carrying portions, and an electrical shock prevention cover disposed so as to cover the terminal base. The electrical shock prevention cover includes openings through which the cables connected to the terminals are passed. The terminal base includes an attachment portion for detachably attaching an opening dimension regulating member in accordance with the thickness of the cables. The opening dimension regulating member is configured to block at least a part of each opening in order to prevent a finger from touching the current carrying portion in a state in which the cables are connected to the terminals.

To attach the plate to the terminal base, the slit is formed in the terminal base, as an example, but the present invention is not limited to this example. An attachment portion may be provided in order to detachably attach the opening dimension regulating member.

As described above, each of the reactors according to the embodiments can prevent contact with the current carrying portions of the terminal base regardless of the thickness of the cables connected to the terminal base of the reactor. As a result, the reactors conform to the protection level IP2X (protection for a solid: protection for a solid object having a diameter of 12 mm (12.5 mm) or more, e.g., a finger), regardless of the thickness of the cables.

According to the reactors of the embodiments of the present invention, it is possible to prevent contact with the current carrying portions of the terminal base regardless of the thickness of the cables connected to the terminal base of the reactor.

What is claimed is:

1. A reactor comprising:

a core body including an outer peripheral iron core, at least three iron cores disposed so as to contact an inside of the outer peripheral iron core or to be coupled to an internal surface of the outer peripheral iron core, and coils wound on the iron cores, a gap formed between one of the iron cores and another of the iron cores adjacent to the one of the iron cores, so as to be magnetically connectable through the gap;

a terminal base including terminals connected to the coils, the terminals being configured to be connected to cables through a current carrying portion; and an electrical shock prevention cover disposed so as to cover the terminal base, wherein the electrical shock prevention cover has openings through which the cables connected to the terminals are passed, and wherein the terminal base has a plate configured to block at least a part of the openings so as to prevent a finger from touching the current carrying portions in a state in which the cables are connected to the terminal, the plate being detachable in accordance with the thicknesses of the cables.

2. The reactor according to claim 1, wherein a slit is formed in the terminal base in the vicinity of the openings, for disposing the plate into the slit.

3. The reactor according to claim 1, wherein depressions are formed in the plate in accordance with the shapes of the cables.

4. The reactor according to claim 1, wherein in a state in which the cable is connected to the terminal, when a cable having a thick diameter which blocks the opening without the use of the plate to such an extent that a finger does not touch the current carrying portion, the plate is detached, and wherein in a state in which the cable is connected to the terminal, when a cable having a thin diameter which does not block the opening without the use of the plate, and a finger can touch the current carrying portion, the plate is attached.

5. A reactor comprising:

a core body including an outer, peripheral iron core, at least three iron cores disposed so as to contact an inside of the outer peripheral iron core or to be coupled to an internal surface of the outer peripheral iron core, and coils wound on the iron cores, a gap formed between one of the iron cores and another of the iron cores adjacent to the one of the iron cores, so as to be magnetically connectable through the gap;

a terminal base including terminals connected to the coils, the terminals being configured so as to be connected to a cable through a current carrying portion; and an electrical shock prevention cover disposed so as to cover the terminal base, wherein the electrical shock prevention cover has openings through which the cables connected to the terminals are passed, and wherein the terminal base has an attachment portion to detachably attach an opening dimension regulating member in accordance with the thicknesses of the cables, the opening dimension regulating member being configured to block at least a part of the openings so as to prevent a finger from touching the current carrying portions in a state in which the cables are connected to the terminals.

* * * * *